US005100617A

United States Patent [19]

Kiilunen et al.

[11] Patent Number: 5,100,617

[45] Date of Patent: Mar. 31, 1992

[54] WIRES MADE OF COPPER-BASED ALLOY COMPOSITIONS

[75] Inventors: David D. Kiilunen, Brighton; David A. Sartor, Sterling Heights, both of Mich.

[73] Assignee: Midwest Thermal Spray Inc., Westland, Mich.

[21] Appl. No.: 622,494

[22] Filed: Dec. 3, 1990

Related U.S. Application Data

[62] Division of Ser. No. 461,296, Jan. 5, 1990, Pat. No. 5,013,587.

[51] Int. Cl.[5] ..... C22C 9/02

[52] U.S. Cl. ..... 420/470; 420/471; 148/24; 219/145.22

[58] Field of Search ..... 420/470, 471, 489, 490; 148/23, 24; 219/145.22, 146.22

[56] References Cited

FOREIGN PATENT DOCUMENTS

| | | | |
|---|---|---|---|
| 179098 | 7/1954 | Austria | 420/471 |
| 49-37885 | 10/1974 | Japan | 420/471 |
| 59-170231 | 9/1984 | Japan | 420/471 |
| 60-86231 | 5/1985 | Japan | 420/471 |
| 60-128234 | 7/1985 | Japan | 420/471 |
| 63-45341 | 2/1988 | Japan . | |

*Primary Examiner*—R. Dean
*Assistant Examiner*—George Wyszomierski
*Attorney, Agent, or Firm*—Bertram F. Claeboe

[57] ABSTRACT

Metal filler compositions and methods of employing the same are disclosed, in which the compositions are copper base with the addition thereto of tin and silicon. For thermal spraying applications, aluminum is included in the formulation. By practice of the invention, substantial improvements in bond strength and quality of the surface finish are achieved.

6 Claims, No Drawings

WIRES MADE OF COPPER-BASED ALLOY COMPOSITIONS

This is a division of application Ser. No. 07/461,296 filed Jan. 5, 1990 now U.S. Pat. No. 5,013,587.

BACKGROUND OF THE INVENTION

It is known in the art to which this invention pertains that during the course of manufacture metal bodies develop surface imperfections therein. Illustratively, in the automotive art, bare metal sections which ultimately form the automobile body are welded together. Inherently in this procedure there results porosity in the weld joint, and ripples or deformations in the metal surfaces proximate to the zone of the welding operation.

Quality considerations dictate that such imperfections be remedied, and the use of solder has been one means employed by the prior art. The soldering technique, however, is disadvantageous from the standpoint of being time-consuming, but also, since a flux is required, there arises the problems of toxicity and later flux removal.

One expedient currently in use in substitution for solder is a silicon bronze alloy, and one material of this type of which applicants have knowledge contains approximately 2.8 to 4.0% silicon. Silicon bronze has the significant advantage over solder of substantial time savings, since it can be applied to the metal surfaces by thermal spraying. When arc spraying is employed, there is less heat transfer to the base, and consequently less bare automobile parts of steel sheet, wherein the general sequence of steps is welding, grinding, thermal spraying, and grinding, even the use of silicon bronze as the sprayable material gives rise to disadvantageous results. Stated briefly, in the second grinding step just mentioned, time and materials expended in the performance thereof have been found to be quite substantial. Additionally, upon completion of the four steps briefly noted, less than optimum results are often noted in the areas of bond strengths and surface appearance.

SUMMARY OF THE INVENTION

Applicants have discovered that there is obtained markedly improved results in the coating of a variety of bare metal substrates by thermal spraying thereon a copper base composition containing tin, silicon, and aluminum. More broadly stated, and prior to thermal spraying, the composition of this invention without the presence of aluminum may be employed in the production of weldments. However, as the description proceeds, it will be noted that the present composition containing aluminum when employed for welding applications, helium rather than argon is the inert shielding gas generally utilized. Further, the composition of this invention without the presence of aluminum can be thermally sprayed, although optimum bond strengths may not at all times be obtained.

In the practice of the present invention an arc spray gun is preferably employed, although a combustion metallizing gun may at times be found suitable. The wire fed to the gun is preferably flux cored wire, but solid wire is also within the contemplation of this invention. If a wire diameter of 0.045 inches is employed, the composition of this invention has broad maximums of up to about 15.0% tin, up to approximately 2.0% silicon, up to about 2.0% aluminum, and the balance copper. Should the wire diameter selected be 0.062 inches, the broad maximums of the ingredients of applicant's composition are up to about 20.0% tin, up to approximately 5.0% silicon, up to about 2.0% aluminum, and the balance copper. In proceeding in accordance with the foregoing, markedly improved results are obtained, particularly by way of bond strengths and surface finishes with an absence of voids therein.

DESCRIPTION OF A PREFERRED EMBODIMENT

While applicants do not wish to be bound by a particular theory, it would appear that aluminum and tin in the composition of this invention contribute importantly to the novel results described herein. From the standpoint of bond strength or adhesion of the coating to a bare metal substrate, the aluminum appears to combine with oxygen in the atmosphere, producing an exothermic reaction. This in turn provides heat to the copper, tin and silicon particles in the composition, and thus being at a substantially elevated temperature, these particles adhere well to the bare metal substrate by a mechanical rather than metallurgical bond. Comparative data on bond strengths of applicants' composition and a known silicon bronze alloy will be set forth hereinafter.

The presence of tin in the composition of this invention, on the other hand, appears to contribute significantly to a visibly smooth or void-free surface finish, and the related aspect of ease of grindability. It is possible that tin also forms an oxide with the atmosphere, and combines with the copper to form an alloy which is softer when compared with silicon bronze. While other theories may exist as to the interaction which takes place between the tin and the other ingredients of the present formulation during thermal spraying, it has been found in actual practice that during the second grinding step earlier noted, there is what may be termed a better "feathering in" or "grindability" of the surface finish. In other words, there is much improved blendability, indicating even to the naked eye an absence of voids or porosity in the surface finish.

In contrast, the silicon bronze material presently used in the thermal spraying for the automotive applications earlier noted, appears to be a much harder alloy. As a consequence, a much greater number of grinding discs are required generally by reason of the clogging thereof, the hardness of the alloy, and consequently the time required to produce a commercially acceptable surface finish is substantially greater.

The approximate upper limits of the ingredients of applicants' composition for thermal spraying applications have been set forth hereinabove, it being noted that there is a relationship to wire diameter. More specifically, in work performed to date, the following compositions have been utilized:

| DESIGNATION | TIN | SILICON | ALUMINUM | COPPER |
|---|---|---|---|---|
| A | 5.5 | 2.0 | 1.0 | Balance |
| B | 5.5 | 2.0 | — | Balance |
| C | 9.5 | 2.0 | 1.5 | Balance |

Components in parts by weight, based on 100 parts.

Compound "B" is particularly well suited for welding applications, although it may be used in thermal spray applications at some modest sacrifice in bond strength. Compounds "A" and "C" have greatest utility for thermal spray applications, although as was noted above, they can be used for welding, if helium is used in place of argon as the inert shielding gas.

By way of Example, a quantity of flux cored wire was produced from an essentially copper strip and in which the fill was Compound "A" as above set forth. The wire diameter was approximately 0.045 inches, and this wire was fed into a Model 8830 arc spray gun manufactured by TAFA Incorporated of Concord, N.H. Utilizing a flux cored wire of the diameter indicated, the spray gun was adjusted to a voltage of 28 in order to deliver a fine mist at 40 psi. A number of bare steel plates measuring 8×8 inches were sprayed to a coating thickness of about 0.045 inches. A smiliar procedure was used with silicon bronze wire, understood to contain 2.8 to 4.0% silicon.

The two sets of coated plates were then tested in the following manner to determine the bond strengths of the two types of coating. The coated surfaces of two plates, each pair having been sprayed with Composition "A" and the other with silicon bronze, had applied thereto a commercially available epoxy cement understood to have a bond strength of 10–12,000 psi. After drying, pull forces were applied to each set of plates, and Composition "A" plates had a coating bond strength of about 4,065 psi, while the silicon bronze coated plates had a bond strength of only approximately 3,000 psi. This is considered to be quite significant, since it clearly indicates that there is little likelihood of applicants' coating flaking from the bare metal surface which ultimately provides an automobile body part subject to shaking, bumping, or other rather strenuous road conditions.

Ease of grindability and the quality of the surface finish obtained are additional factors wherein noticeable improvements result from practice of the novel concepts of this invention. The presence of tin in the composition is believed to contribute importantly in this area by producing after deposition with the other ingredients what may be termed a "softer" finish. The grind rate is improved from the standpoint that a lesser number of grinding discs are required in order to produce the desired blemish-free surface finish, as compared with a deposit of silicon bronze. In this manner, the savings of time and materials are quite significant.

The quality of the surface finish is considered critical in the production of automobile body parts. The initial surface coating, or under coating, as produced in the manner hereinabove described, is in effect duplicated in subsequent paint costs. In other words, any ripples, undulations, voids, or other imperfections in the bare metal surface coating carry through the later-applied paint coats and are clearly visible therein. High quality in the surface finish of the initial surface coating is accordingly highly important.

It has been noted by applicants that substantial differences are found in the surface finish produced by the filler metal of this invention and that provided by silicon bronze. Utilizing the same grit discs employed in automobile body part plants, the present filler metal designated as Composition "A" above feathered well during the passes of the grinding wheel, and there was excellent blending in the finish as the strokes were made. The completed finish had feathered or blended very well into the steel, indicating high quality. In work performed to date, like results have not produced from a silicon bronze coating.

Changes and modifications to the formulations and procedures of this invention have been described herein, and these and other variations may, of course, be practiced without departing from the spirit of the invention or the scope of the subjoined claims.

We claim:

1. A flux cored wire for application to essentially bare metal surfaces, said wire being constructed of a copper-base alloy consisting essentially of about 5.5% tin and approximately 2.0% silicon.

2. A flux cored wire for thermal spraying bare metal surfaces having imperfections therein, said wire being constructed of a copper-base alloy consisting essentially of about 5.5% tin and approximately 2.0% silicon.

3. A wire for application to essentially bare metal surfaces, said wire being constructed of a copper-base alloy consisting essentially of from about 5.5% to about 20.0% tin, from about 2.0% to about 5.0% silicon, and from about 1.0% to about 2.0% aluminum.

4. A flux cored wire for thermal spraying essentially bare metal surfaces having imperfections therein, said wire being constructed of a copper-based alloy consisting essentially of up to about 20.0% tin, up to approximately 5.0% silicon, and up to about 2.0% aluminum.

5. A flux cored wire as defined in claim 4, in which the copper-base alloy consists essentially of about 5.5% tin, approximately 2.0% silicon, and about 1.0% aluminum.

6. A flux cored wire as defined in claim 4, in which the copper-base alloy consists essentially of about 9.5% tin, approximately 2.0% silicon, and about 1.5% aluminum.

* * * * *

UNITED STATES PATENT AND TRADEMARK OFFICE

CERTIFICATE OF CORRECTION

PATENT NO. : 5,100,617

DATED : MARCH 31, 1992

INVENTOR(S) : DAVID D. KIILUNEN AND DAVID A. SARTOR

It is certified that error appears in the above-identified patent and that said Letters Patent is hereby corrected as shown below:

On title page, item [73] Assignee, should read

DAVID A. SARTOR TO
MIDWEST THERMAL SPRAY, INC.
WESTLAND, MICH.

Signed and Sealed this

Third Day of August, 1993

*Attest:*

*Attesting Officer*

Michael K. Kirk

MICHAEL K. KIRK

*Acting Commissioner of Patents and Trademarks*